US006481446B2

(12) United States Patent
Yang et al.

(10) Patent No.: US 6,481,446 B2
(45) Date of Patent: Nov. 19, 2002

(54) METHOD OF CLEANING A POLISHING PAD CONDITIONER AND APPARATUS FOR PERFORMING THE SAME

(75) Inventors: Min-Soo Yang, Suwon (KR); Min-Gyu Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/901,049

(22) Filed: Jul. 10, 2001

(65) Prior Publication Data

US 2002/0048957 A1 Apr. 25, 2002

(30) Foreign Application Priority Data

Sep. 7, 2000 (KR) ..... 2000-53074

(51) Int. Cl.[7] ..... B08B 3/04
(52) U.S. Cl. ..... 134/102.2; 134/182; 134/902
(58) Field of Search ..... 134/102.1, 102.2, 134/182.902

(56) References Cited

U.S. PATENT DOCUMENTS 3,259,049 A * 7/1966 Uithoven ..... 134/102.2
4,967,777 A * 11/1990 Takayama et al. ..... 134/902 X
6,033,290 A 3/2000 Gurusamy et al.
6,048,405 A * 4/2000 Skrovan et al. ..... 134/902 X
6,273,107 B1 * 8/2001 Adams et al. ..... 134/102.1

FOREIGN PATENT DOCUMENTS

JP 10-29461 11/1998

* cited by examiner

*Primary Examiner*—Philip Coe
(74) *Attorney, Agent, or Firm*—Volentine Francos, P.L.L.C.

(57) ABSTRACT

A polishing pad conditioner cleaning method and an apparatus for effectively removing particles from a polishing pad conditioner. The polishing pad conditioner is immersed into a cleaning liquid contained in a cleaning bath. The cleaning liquid is continuously supplied into the cleaning bath. An inert gas is injected into the cleaning liquid from a bottom of the cleaning bath. The injected inert gas bubbles the cleaning liquid, so that the particles sticking to the polishing pad conditioner are removed and overflow from the cleaning bath. The polishing pad conditioner is effectively cleaned, so that formation of particles and scratches on a wafer are reduced when a polishing process is subsequently carried out using the cleaned polishing pad conditioner.

14 Claims, 4 Drawing Sheets

METHOD OF CLEANING A POLISHING PAD CONDITIONER AND APPARATUS FOR PERFORMING THE SAME

The present application claims priority under 35 U.S.C. code 119 to Korean Application No. 2000-53074 filed on Sep. 7, 2000, which is hereby incorporated by reference in its entirety for all purposes.

BACKGROUND OF THE INVENTION

1. Field of the Invention

The present invention relates to a method of cleaning a polishing pad conditioner and an apparatus for performing the same, more particularly, to a method of cleaning a polishing pad conditioner of a semiconductor device and an apparatus for performing the same, by which particles sticking to a diamond disc of the polishing pad conditioner can be effectively removed.

2. Description of the Related Art

Generally, a semiconductor chip is fabricated by treating a wafer made of silicon by using a semiconductor manufacturing device. The wafer is fabricated into a semiconductor chip through semiconductor manufacturing processes such as lithography, chemical and mechanical polishing, chemical or physical deposition and plasma etching processes.

While the semiconductor manufacturing processes are being carried out, particles such as compounds or dusts remain on a surface of the wafer. In addition, the particles stick to the semiconductor manufacturing device, thereby resulting in processing failure. Accordingly, a cleaning process for removing the particles is carried out while the wafer is being fabricated. Various kinds of cleaning methods and devices have been suggested. For example, a cleaning device having a brush for cleaning a spin chuck which coats a photo resist on the wafer is disclosed in Japanese Laid-open Publication No. 10-294261. The cleaning device exhausts nitrogen gas while injecting a cleaning liquid such as acetone so as to remove the particles.

The cleaning process has to be continuously carried out while the semiconductor manufacturing process is being performed. Particularly, the cleaning process is inevitably required after the chemical and mechanical polishing process is finished. Since the chemical and mechanical polishing process polishes the wafer by introducing slurries on to the surface of the wafer, a great amount of slurries stick to the wafer and the chemical and mechanical polishing device. The slurries remaining on the wafer or the chemical and mechanical polishing device are solidified, thereby forming particles which scratch the wafer.

The chemical and mechanical polishing device includes a platen on which a polishing pad is installed, a polishing head for sucking and pressing the wafer, and a polishing pad conditioner for conditioning the polishing pad so as to prevent abrasion of the polishing pad. The slurries also stick to the parts of the chemical and mechanical polishing device while the polishing process is being carried out, so the cleaning process has to be performed with respect to the parts of the chemical and mechanical polishing device after the polishing process has been finished. In addition, the slurries can flow into a driving part for driving the parts of the chemical and mechanical polishing device, thereby resulting in faulty operation of the driving part. U.S. Pat. No. 6,033,290 discloses a polishing pad conditioner using a fluid fuzzy system for preventing impurities including slurries from flowing into an interior of a conditioner head which drives a polishing pad conditioner in the upward and downward directions.

The conditioning of the polishing pad is carried out by using a diamond disc attached to the polishing pad conditioner. The diamond disc applies a predetermined pressure to an upper surface of the polishing pad so as to improve the quality of the upper surface of the polishing pad. However, since the diamond disc directly makes contact with the slurries formed on the polishing pad, the slurries can stick to the diamonds on the diamond disc. As time goes by, the slurries sticking to the diamonds are solidified so that the conditioning effect of the diamond disc on the polishing pad is lowered by the solidified slurries. In addition, the solidified slurries can drop onto the surface of the polishing pad while the polishing work is being carried out, so that the upper surface of the wafer can be scratched. Accordingly, cleaning of the polishing pad conditioner after the polishing process is necessarily required. The cleaning of the polishing pad conditioner is performed by using a polishing pad cleaning apparatus installed at one side of a polishing device.

FIG. 1 shows a conventional polishing pad conditioner cleaning device. Particularly, the polishing pad conditioner cleaning apparatus shown in FIG. 1 cleans a diamond disc for conditioning a polishing pad, in a polishing pad conditioner. Referring to FIG. 1, the polishing pad conditioner cleaning apparatus has a cleaning bath 10 which contains a cleaning liquid 12 for cleaning the polishing pad conditioner. The polishing pad conditioner coupled with a diamond disc is immersed into the cleaning liquid 12 in the cleaning bath 10, after the cleaning work of the polishing pad is completed. The cleaning liquid includes deionized water. An upper portion of the cleaning bath 10 is opened. A cleaning liquid supplying part 14 for supplying the cleaning liquid into the cleaning bath 10 is provided at a side of the cleaning bath 10. A brush 16 is provided at a lower portion of an inner portion of the cleaning bath 10. After the polishing pad conditioner coupled with the diamond disc is immersed into the cleaning bath 10, the brush 16 makes contact with the diamond disc so as to remove particles including the slurries, from the diamond disc. A draining part 18 is provided at an outer portion of the cleaning bath 10. The draining part 18 collects overflow cleaning liquid 12 from the cleaning bath 10, and drains the overflow cleaning liquid to an exterior.

The polishing pad conditioner cleaning apparatus having the above structure cleans the polishing pad conditioner as follows. When the polishing process for flattening the surface of the wafer has been finished, the polishing pad conditioner is conveyed into the polishing pad cleaning apparatus. Then, the polishing pad conditioner is immersed into the cleaning liquid 12 in the cleaning bath 10. The diamond disc of the polishing pad conditioner makes contact with the brush 16 installed at the lower portion of the inner portion of the cleaning bath 10, so that the slurries sticking to the diamond disc are removed. The cleaning liquid 12 is supplied from the cleaning liquid supplying part. The cleaning liquid 12 overflows from the cleaning bath 10, as the cleaning liquid 12 is continuously supplied into the cleaning bath 10.

However, the slurries sticking to the polishing pad conditioner cannot be completely removed by simply contacting the polishing pad conditioner with the brush. The slurries thus remaining in the polishing pad conditioner are solidified so that the conditioning effect of the polishing pad conditioner on the polishing pad is lowered, which may result in the surface of the wafer becoming scratched. In addition, the slurries removed from the polishing pad conditioner settle at the bottom of the cleaning bath without flowing out of the cleaning bath, so that the slurries become deposited in the brush while the cleaning process is being carried out. The slurries deposited in the brush can contaminate the diamond disc of the polishing pad conditioner, so that it also becomes necessary to periodically remove the slurries from the brush. However, removing the slurries from the brush is very difficult and requires a lot of time. In addition, since the diamond disc frequently makes contact with the brush while the cleaning process is being carried out, parts of the brush can be separated from the brush. The separated parts of the brush can stick to the diamond disc. In this case, the surface of the wafer is scratched by the separated parts of the brush sticking to the diamond disc during conditioning of the polishing pad using the diamond disc.

SUMMARY OF THE INVENTION

The present invention is therefore directed to a method of cleaning a polishing pad conditioner, and an apparatus for performing the same, which substantially overcomes one or more of the problems due to the limitations and disadvantages of the related art.

The present invention has been made to solve the problems of the related art, and accordingly, a first object of the present invention is to provide a method of cleaning a polishing pad conditioner, which can effectively remove particles sticking to the polishing pad conditioner.

A second object of the present invention is to provide a cleaning apparatus for performing the cleaning method.

To accomplish the first object of the present invention, there is provided a method of cleaning a polishing pad conditioner including immersing the polishing pad conditioner into a cleaning bath containing a cleaning liquid. The cleaning liquid is bubbled by injecting an inert gas into the cleaning liquid from a bottom of the cleaning bath. Additional cleaning liquid is supplied into the cleaning bath.

To accomplish the second object of the present invention, there is provided an apparatus for cleaning a polishing pad conditioner, including a cleaning bath containing a cleaning liquid. A gas injecting part injects an inert gas into the cleaning liquid from a bottom of the cleaning bath. A cleaning liquid supplying part supplies the cleaning liquid into the cleaning bath. The polishing pad conditioner coupled with a diamond disc is immersed into the cleaning liquid and the inert gas is injected into the cleaning liquid from the bottom of the cleaning bath thereby bubbling the cleaning liquid. By the bubbling of the cleaning liquid, the particles including slurries sticking to the polishing pad conditioner are effectively removed. In addition, the particles removed from the polishing pad conditioner overflow from the cleaning bath by the pressure of the inert gas injected from the bottom of the cleaning bath, without floating on the cleaning liquid or settling at the bottom of the cleaning bath. Accordingly, the polishing pad conditioner is prevented from being contaminated by the particles in the cleaning bath.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Hereinafter, the present invention will be described in detail with reference to the accompanying drawings.

Figure 1:
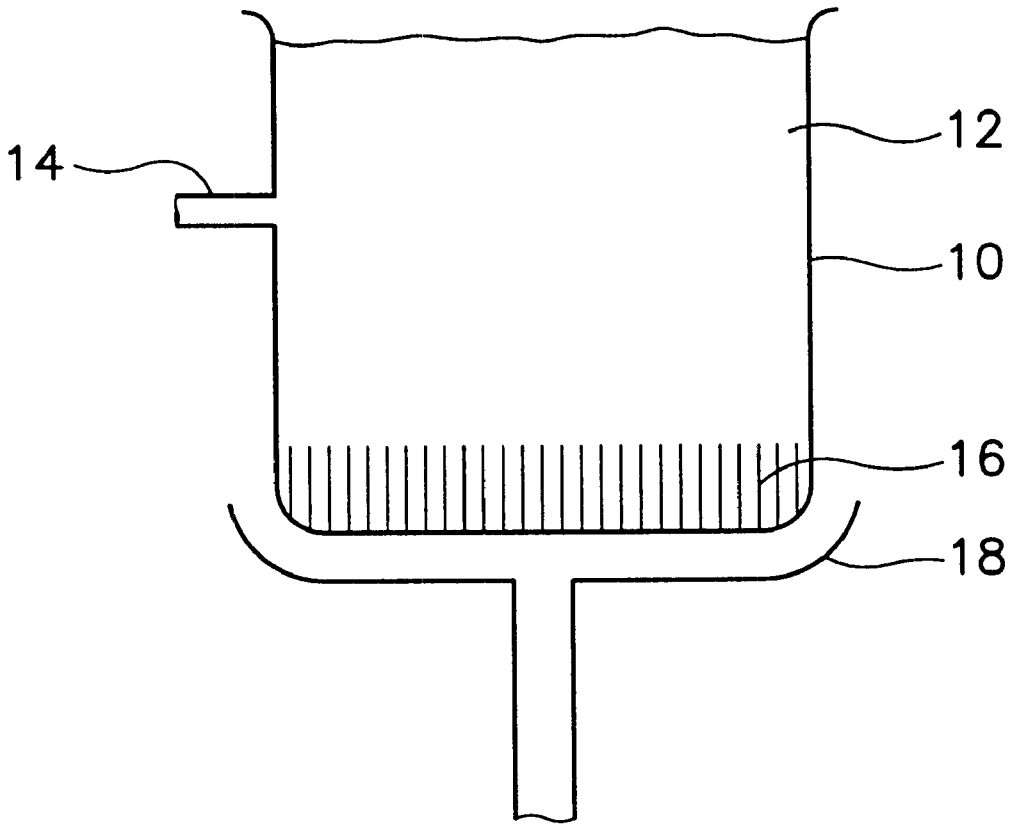
FIG. 1 (PRIOR ART)
FIG. 1 is a view showing a conventional polishing pad conditioner cleaning apparatus.
Figure 2:
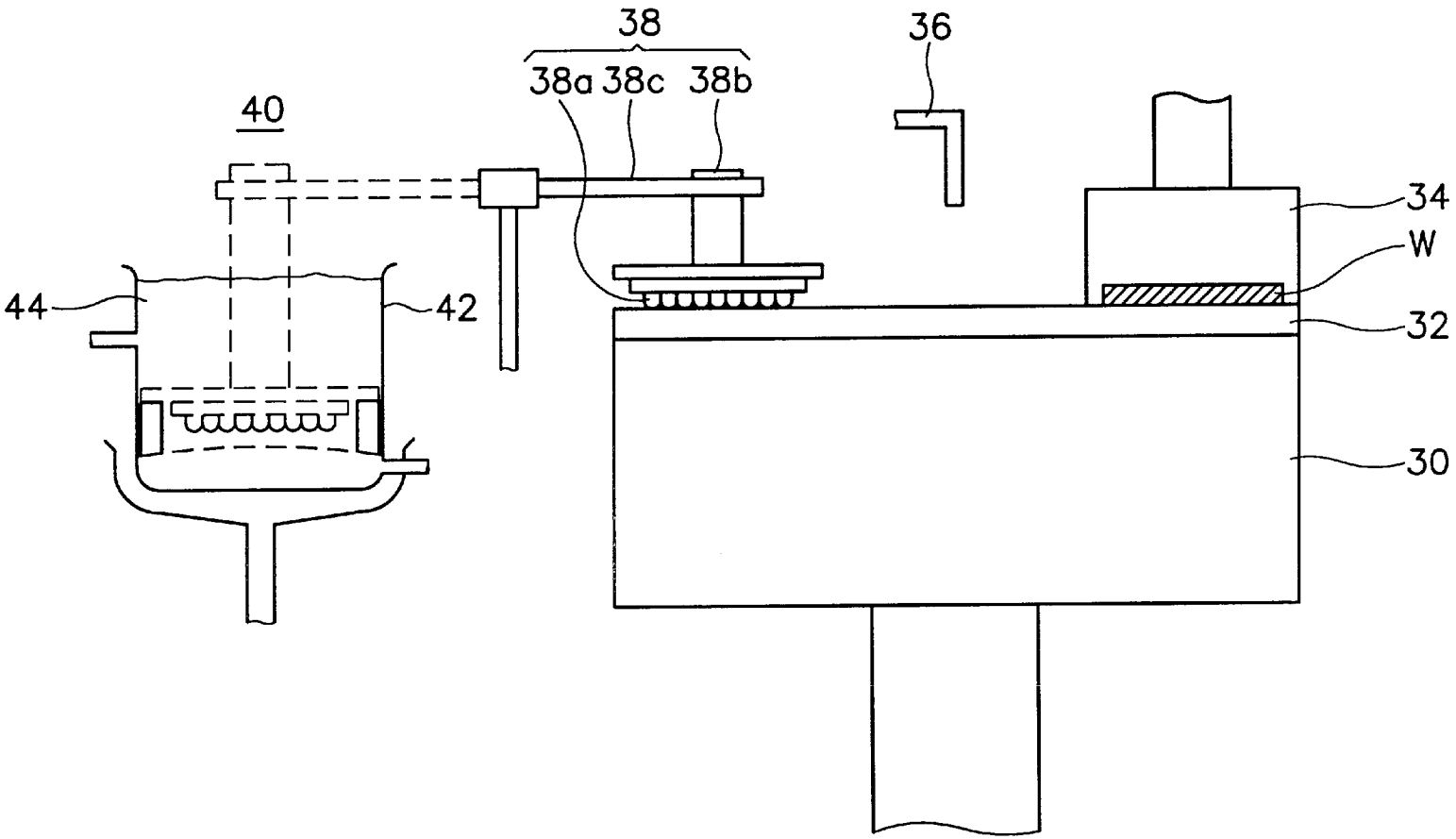
FIG. 2 is a view showing a polishing device including a polishing pad conditioner cleaning apparatus.

FIG. 2 shows a polishing apparatus including a polishing pad conditioner cleaning apparatus according to one embodiment of the present invention. Referring to FIG. 2, a polishing pad 32 for polishing a wafer W is installed on a platen 30 which can be rotated. The polishing pad 32 is formed with grooves, which increases a contact area of the polishing pad 32 with respect to the wafer W, thereby improving the polishing effect. A polishing head 34 is provided to load the wafer W on the polishing pad 32, by applying vacuum pressure to the wafer W. The polishing head 34 rotates while pressing the wafer W. The polishing head 34 rotates and moves up and down by the driving force of a motor. A plurality of polishing pads 32 and polishing heads 34 can be provided, so as to simultaneously polish a plurality of wafers W. A slurry supplying part 36 for supplying slurries onto the polishing pad 32 is installed over the polishing pad 32. The slurries are supplied onto the wafer W loaded on the polishing pad 32 by the centrifugal force of the polishing pad 32.

A polishing pad conditioner 38 for conditioning the surface of the polishing pad 32 is disposed adjacent to the polishing pad 32. The conditioning of the polishing pad 32 by the polishing pad conditioner 38 is however carried out when slurries and polishing particles exist in the grooves of the polishing pad 32, or when the grooves are worn. The conditioning of the polishing pad 32 is performed simultaneously with the polishing of the wafer W. In addition, a polishing pad conditioner cleaning apparatus 40 for cleaning the polishing pad conditioner 38 is provided.

Hereinafter, the polishing pad conditioner 38 will be explained in detail. The polishing pad conditioner 38 is disposed adjacent to the polishing pad 32. The polishing pad conditioner 38 is provided with a diamond disc 38*a* for conditioning the polishing pad 32 by making contact with the polishing pad 32. The diamond disc 38*a* consists of a plate having recesses and prominences and a plurality of industrial diamonds which are densely attached to the plate. The diamonds make contact with the surface of the polishing pad 32. In this state, the diamond disc 38*a* rotates so as to perform the conditioning of the polishing pad 32. The rotational direction of the polishing pad conditioner 38 is identical to the rotational direction of the polishing pad 32.

A polishing pad conditioner head 38*b* is connected to the diamond disc 38*a*. The polishing pad conditioner head 38*b* rotates in order to allow the diamond disc 38*a* to rotate on the polishing pad 32. In addition, the polishing pad conditioner head 38*b* moves up and down in order to allow the diamond disc 38*a* to make contact with the polishing pad 32, or to be separated therefrom. A conveying part 38c is connected to the polishing pad conditioner head 38*b* so as to convey the polishing pad conditioner 38. The conveying part 38*c* is fixedly installed adjacent to the polishing pad 32. In this state, the conveying part 38*c* rotates in order to convey the polishing pad conditioner 38 to the polishing pad 32 or the polishing pad cleaning apparatus 40.

While the conditioning of the polishing pad 32 by the polishing pad conditioner 38 is being carried out, the platen 30, on which the polishing pad 32 is installed, is rotated so that the polishing pad 32 making contact with the wafer W is also rotated, thereby polishing the wafer W. The diamond disc 38*a* of the polishing pad conditioner 38 is conveyed to an upper portion of the polishing pad 32 by the conveying part 38*c*.

Then, the polishing pad conditioner head 38*b* moves down so that the diamond disc 38*a* makes contact with the upper surface of the polishing pad 32. In this state, the diamond disc 38*a* rotates in the rotational direction of the polishing pad 32. Accordingly, a predetermined pressure is applied to the upper surface of the polishing pad 32 by the diamond disc 38*a*, thereby improving the quality of the surface of the polishing pad 32.

Since the polishing pad conditioner 38 performs the conditioning of the polishing pad 32 while the polishing of the wafer W is being executed, a lot of slurries stick to the diamond disc 38*a* of the polishing pad conditioner 38. The slurries are solidified as time goes by, and the solidified slurries cause the wafer W to be scratched. Accordingly, the polishing pad conditioner 38 coupled with the diamond disc 38*a* has to be cleaned after the polishing process is finished.

The cleaning of the polishing pad conditioner 38 is performed by the polishing pad conditioner cleaning apparatus 40 which is installed adjacent to the polishing pad conditioner 38. In order to clean the polishing pad conditioner 38, the diamond disc 38*a* of the polishing pad conditioner 38 is moved to an upper portion of a cleaning bath or reservoir 42 by the conveying part 38*c*, as shown in FIG. 2 with dotted lines. Then, the polishing pad conditioner head 38*b* is immersed into a cleaning liquid 44 in the cleaning bath 42. At this time, bubbles form in the cleaning liquid 44 by an inert gas injected from a bottom of the cleaning bath 42, so that the polishing pad conditioner 38 is cleaned.

Figure 3:
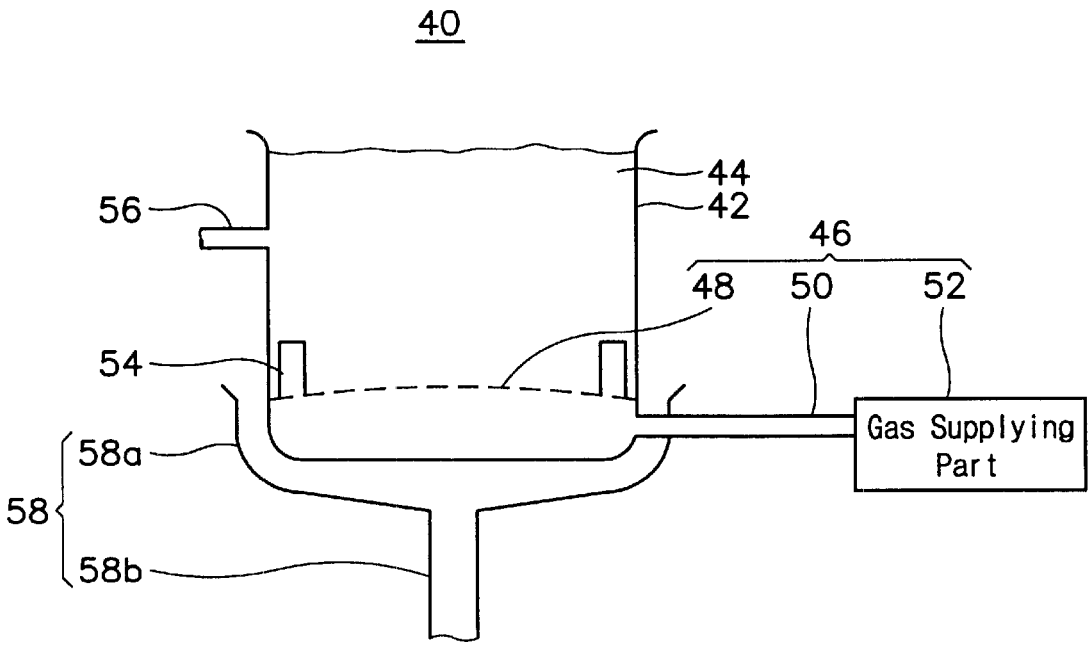
FIG. 3 is a view showing a polishing pad conditioner cleaning apparatus according to an embodiment of the present invention.

FIG. 3 shows the polishing pad conditioner cleaning apparatus 40 for cleaning the polishing pad conditioner 38. The polishing pad conditioner cleaning apparatus 40 removes particles, such as slurries, that stick to the diamond disc 38*a* of the polishing pad conditioner 38.

Referring to FIG. 3, the polishing pad conditioner cleaning apparatus 40 includes the cleaning bath 42 containing cleaning liquid 44 therein. The cleaning liquid includes pure water or deionized water. For example, deionized water is used as the cleaning liquid in this example. The cleaning of the polishing pad conditioner cleaning apparatus 40 is carried out by immersing the polishing pad conditioner cleaning apparatus 40 coupled with the diamond disc 38*a*, into the cleaning liquid 44 of the cleaning bath 42. An upper portion of the cleaning bath 42 is opened. A cleaning liquid supplying part 56 is provided to supply the cleaning liquid 44 into the cleaning bath 42.

A gas injecting part 46 is provided at the bottom of an inner portion of the cleaning bath 40, in order to inject inert gas into the cleaning liquid 44. The gas injecting part 46 includes a plate 48 having an interior space therein and formed with a plurality of pores in communication with the interior space, a gas pipe 50 connected to a side of the plate 48 for injecting the inert gas into the interior space, and a gas supplying part 52 for supplying the inert gas into the gas pipe 50. The inert gas is introduced from the gas supplying part 52 to the interior space of the plate 48, and then is injected into the cleaning liquid 44 through the pores of the plate 48. The plate 48 is assembled to a lower portion of the cleaning bath 42. A rubber ring may be attached around a periphery of the plate 48, thereby fixedly assembling the plate 48 to the lower portion of the cleaning bath 42. Since the plate 48 is placed in the cleaning liquid 44, the plate 48 is made of an anti-corrosive material.

A plurality of guide pins 54 are provided at an edge of the upper surface of the plate 48. The polishing pad conditioner 38 coupled with the diamond disc 38*a* is placed on the guide pins 54, so that the polishing pad conditioner 38 is spaced by a predetermined distance apart from the gas injecting part 46.

The inert gas generated from the gas injecting part 46 forms bubbles in the cleaning liquid 44, so as to clean the polishing pad conditioner 38 coupled with the diamond disc 38*a*. The particles removed from the polishing pad conditioner 38 and the diamond disc 38*a* overflow from the cleaning bath 42 together with the cleaning liquid 44.

A draining part 58 is provided to collect and drain the cleaning liquid 44 that overflows from the cleaning bath 42. The overflow cleaning liquid 44 from the cleaning bath 42 is collected in a recess formed at an exterior of the cleaning bath 42. Then, the overflow cleaning liquid flows along the recess and is drained through a draining line 58*b*. According to another embodiment of the present invention, an outer tub 58*a* which is provided at the exterior of the cleaning bath 42 collects the overflow cleaning liquid 44 from the cleaning bath 42, and drains the overflow cleaning liquid 44 through the draining line 58*b*.

Figure 4:
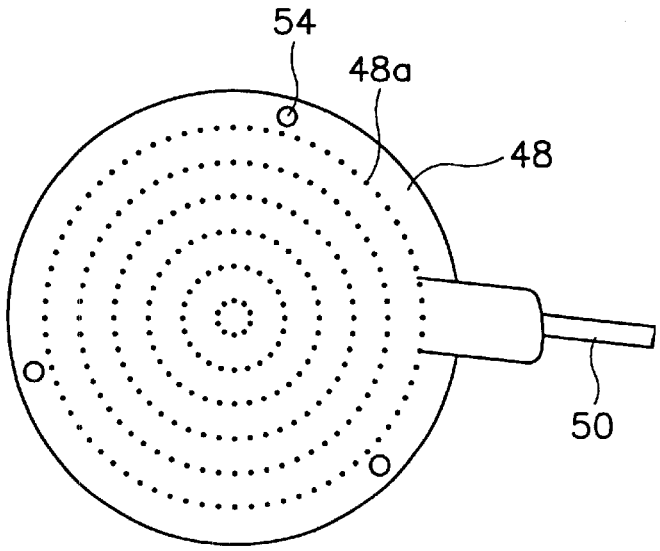
FIG. 4 is a front view showing a plate of a polishing pad conditioner cleaning apparatus according to an embodiment of the present invention.

FIG. 4 shows the plate 48 of the polishing pad conditioner cleaning apparatus according to an embodiment of the present invention. Referring to the FIG. 4, the plate 48 is formed with a plurality of pores 48*a* at an upper portion thereof and has an interior space therein. Preferably, the plate 48 has 200 to 500 pores 48*a*. Since the inert gas is injected through the pores 48*a*, the pores 48*a* are formed in such a manner that the inert gas can be uniformly injected onto the polishing pad conditioner 38 coupled with the diamond disc 38*a*. The pores 38*a* may be concentrically formed in the plate 48, while maintaining a constant distance therebetween.

A gas pipe 50 is connected to a side portion of the plate 48. The inert gas is introduced into the interior space of the plate 48 through the gas pipe 50. The inert gas introduced into the interior space of the plate 48 is injected into the cleaning liquid 44 through the pores 48*a* of the plates from the bottom of the cleaning bath 42. The inert gas includes nitrogen gas and argon gas. Nitrogen gas is used as the inert gas in this example.

A plurality of guide pins 54 are provided on the upper surface of the plate 48. The polishing pad conditioner 38 coupled with the diamond disc 38*a*, when placed in cleaning bath 42, is spaced a predetermined distance apart from the plate 48 by the guide pins 54. If the polishing pad conditioner 38 is closely adjacent to the plate 48, the bubbling effect on the cleaning liquid 44 is lowered, thereby reducing the cleaning effect on the polishing pad conditioner 38. By positioning the guide pins 54 between the plate 48 and the polishing pad conditioner 38, the cleaning effect on the polishing pad conditioner 38 can be increased. In addition, the guide pins 54 are provided at a periphery portion of the plate 48 in such a manner that an edge portion of the diamond disc 38*a*, in which diamonds for conditioning the polishing pad 32 are not provided, can be positioned on the guide pins 54. Accordingly, abrasion of the diamonds caused by the contact between the guide pins 54 and the diamonds can be prevented. Three guide pins 54 may be provided for example, so that the polishing pad conditioner 38 may be stably mounted within cleaning bath 42.

A center of the upper surface of the plate 48 is convex so that a thickness of the plate 48 at the center thereof is thicker than a thickness of the plate 48 at an edge portion thereof. When the conditioning of the polishing pad 32 is carried out, lots of the slurries stick to the center of the diamond disc 38*a* coupled with the polishing pad conditioner 38. Accordingly, by making the center of the upper surface of the plate 48 convex, the distance between the pores 48*a* and the diamond disc 38*a* is relatively small, so that the pressure of the inert gas injected through the pores 48*a* is increased, thereby improving the cleaning effect at the center of the diamond disc 38*a*.

Figure 5:
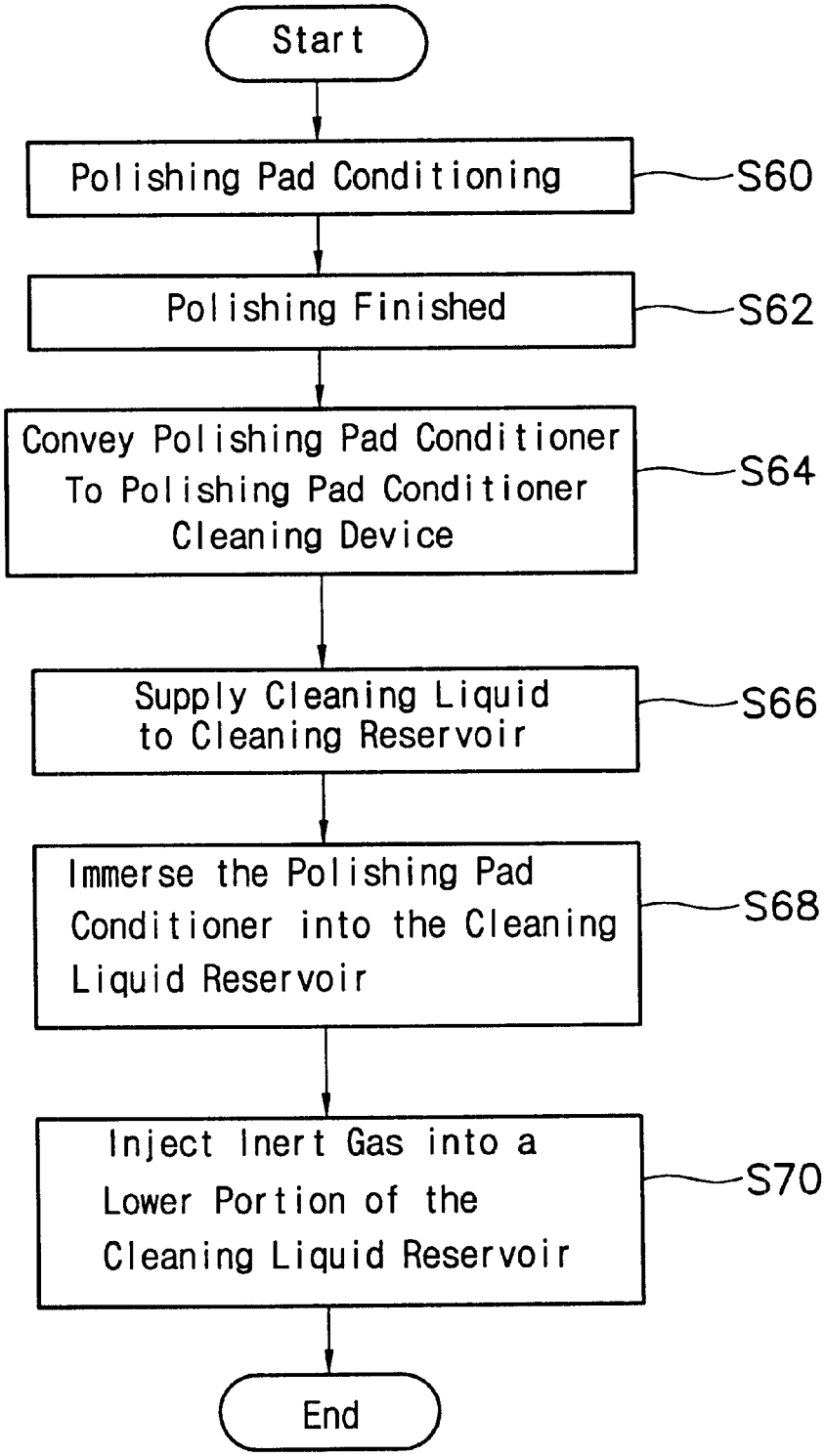
FIG. 5 is a flow chart showing a cleaning method of the polishing pad conditioner according to an embodiment of the present invention.

FIG. 5 shows a flow chart for explaining a cleaning method of the polishing pad conditioner 38 according to an embodiment of the present invention. Referring to FIG. 5, the conditioning of the polishing pad 32 is firstly carried out by using the polishing pad conditioner 38 (step S60). The conditioning of the polishing pad 32 and the polishing of the wafer are simultaneously carried out. In detail, the polishing pad conditioner head 38*b* moves down so as to make contact with the surface of the polishing pad 32 to be polished. Then, the polishing pad head portion 38*b* rotates in the rotational direction of the polishing pad 32, thereby conditioning the surface of the polishing pad 32.

When the polishing of the wafer with the polishing pad 32 is finished (step S62), the polishing pad conditioner 38 is conveyed to the polishing pad conditioner cleaning apparatus 40 (step S64). In detail, the polishing pad conditioner head 38*b* moves upward, so that the diamond disc 38*a* is separated from the surface of the polishing pad 32. Then, the conveying part 38*c* conveys the polishing pad conditioner 38 such that the diamond disc 38*a* is positioned at the upper portion of the cleaning bath 42 of the polishing pad conditioner cleaning apparatus 40. At this time, the cleaning liquid 44 is continuously supplied into the cleaning bath 42 by the cleaning liquid supplying part 56 (step S66).

When the diamond disc 38*a* of the polishing pad conditioner 38 is positioned at the upper portion of the cleaning bath 42, the polishing pad conditioner head 38*b* moves down, so that the polishing pad conditioner 38 is immersed into the cleaning liquid 44 contained in the cleaning bath 42 (step S68). For example, deionized water is used as the cleaning liquid. At this time, the polishing pad conditioner 38 is spaced a predetermined distance apart from the gas injecting part 46. By spacing the gas injecting part 46 from the polishing pad conditioner 38, the bubbling effect of the cleaning liquid 44 can be improved. For example, the distance between the gas injecting part 46 and the polishing pad conditioner 38 may be in a range of 3 to 5 mm.

When the polishing pad conditioner 38 is immersed into the cleaning liquid 44, the inert gas is injected from the gas injecting part 46 provided at a lower portion of the cleaning bath 42. The inert gas is continuously injected until the cleaning of the polishing pad conditioner 38 is finished (step S70). The inert gas includes nitrogen gas and argon gas. In an alternative, nitrogen gas may be used as the inert gas. The inert gas has to be uniformly injected towards the front portion of the diamond disc 38*a* of the polishing pad conditioner 38 which is immersed into the cleaning liquid 44. Accordingly, the inert gas is uniformly injected from the lower portion of the cleaning bath 42 to the upper portion of the cleaning bath 42. By the injection of the inert gas, bubbling of the cleaning liquid 44 is created in the cleaning bath 42, so that particles including the slurries sticking to the polishing pad conditioner 38 are separated from the polishing pad conditioner 38. Due to the pressure of the inert gas injected from the lower portion of the cleaning bath 42, the particles overflow from the cleaning bath 42 without floating on the cleaning liquid 44 or settling at the bottom of the cleaning bath 42. Since the particles effectively overflow from the cleaning bath 42 by the pressure of the inert gas, the polishing pad conditioner 38 is prevented from being contaminated by the particles.

When the cleaning process is finished, the polishing pad conditioner head 38*b* moves upward so that the polishing pad conditioner 38 coupled with the diamond disc 38*a* is removed from the cleaning liquid 44.

Accordingly, the particles sticking to the polishing pad conditioner 38 are effectively removed by the bubbling of the cleaning liquid 44. In addition, since the particles overflow from the cleaning bath or reservoir 42 together with the cleaning liquid 44, without floating on the cleaning liquid 44 or settling at the bottom of the cleaning bath 42, contamination of the polishing pad conditioner 38 caused by the particles is prevented. Accordingly, the wafer is prevented from being scratched by the polishing pad conditioner when polishing of the wafer is being carried out. In addition, since the solidified slurries do not exist around the polishing pad conditioner cleaning apparatus, the semiconductor device can be easily managed.

Measurement of the Particles

The following is a comparison of the number of particles generated when polishing of wafers is carried out using the polishing pad conditioner cleaning apparatus of the preferred embodiments of this application, with respect to the number of particles generated when polishing of wafers is carried out using a conventional polishing pad conditioner cleaning apparatus. The particles include scratches formed on the wafers. Table 1 shows the results of the comparison.

TABLE 1

| | number of particles in the conventional apparatus | number of particles in the apparatus of the present invention | particle reduction effect (%) |
|---|---|---|---|
| polishing apparatus 1 | 83 | 78 | 6.0 |
| polishing apparatus 2 | 85 | 74 | 12.9 |
| polishing apparatus 3 | 78 | 64 | 17.9 |
| polishing apparatus 4 | 105 | 91 | 13.3 |
| polishing apparatus 5 | 100 | 91 | 9.0 |
| average | | | 11.8 |

As shown in Table 1, the polishing pad conditioner cleaning apparatus of the preferred embodiments as shown in FIGS. 2 and 3, was used to clean polishing pad conditioners of randomly selected polishing apparatuses 1 to 5. Then, the polishing pads were polished using the cleaned polishing pad conditioners. After polishing of the polishing pads was carried out, the number of particles generated on the wafer in each case was measured. In the same manner, a conventional polishing pad conditioner cleaning apparatus was used to clean polishing pad conditioners of the same randomly selected polishing apparatuses 1 to 5. Then, the polishing pads were polished using the cleaned polishing pad conditioners. After polishing of the polishing pads was carried out, the number of particles generated on the wafer in each case was measured. The number of particles shown in Table 1 are mean values of the accumulated data which is measured after polishing wafers over a span of 30 days, by applying the conventional pad conditioner cleaning apparatus and the pad conditioner cleaning apparatus of the present invention to polishing apparatuses 1 to 5.

According to Table 1, the number of particles decreased by about 6 to 18% depending on the polishing apparatuses. The particles decreased by about 11.8% on average. It is to be noted that while the polishing process is being carried out, particles can be generated on the wafer due to the polishing pad conditioner or due to other factors, such as particles already existing on the polishing pad itself. Accordingly, the particle reduction effect according to the present invention, which is 11.8% on average, indicates that particles generated by the polishing pad conditioner are almost all removed.

As described above, the slurries sticking to the polishing pad conditioner are effectively removed by bubbling the cleaning liquid with inert gas injected into the cleaning bath. In addition, since the particles removed from the polishing pad conditioner overflow from the cleaning bath without floating on the cleaning liquid or settling at the bottom of the cleaning bath, the polishing pad conditioner can be prevented from being contaminated by the particles. Accordingly, particles or scratches, which are formed on the wafer by contamination of the polishing pad conditioner when the wafer is polished, are reduced so that the reliability and producibility of the semiconductor devices are improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for cleaning a polishing pad conditioner comprising:

a cleaning bath that contains a cleaning liquid;

a gas injector that injects an inert gas into the cleaning liquid from a bottom of said cleaning bath, said gas injector including a plate having an interior space therein and formed with a plurality of pores in communication with the plate, a gas pipe, connected to a side of the plate, through which the inert gas is injected into the space, and a gas supplier that supplies the inert gas into the gas pipe; and a cleaning liquid supplier that supplies the cleaning liquid into said cleaning bath, wherein a plurality of guide pins are provided on an edge portion of an upper surface of the plate, to separate the polishing pad conditioner from the plate when the polishing pad conditioner is fully immersed into said cleaning bath.

2. The apparatus for cleaning a polishing pad conditioner as claimed in claim 1, wherein the plate is made of an anti-corrosive material.

3. The apparatus for cleaning a polishing pad conditioner as claimed in claim 1, wherein a length of the guide pins is in a range of about 3–5 mm.

4. The apparatus for cleaning a polishing pad conditioner as claimed in claim 1, wherein a center of an upper surface of the plate is convex and has a first thickness, and an edge portion of the plate has a second thickness, the first thickness being greater than the second thickness.

5. The apparatus for cleaning a polishing pad conditioner as claimed in claim 1, further comprising a drain that collects overflow cleaning liquid from said cleaning bath.

6. The apparatus for cleaning a polishing pad conditioner as claimed in claim 5, wherein said drain comprises:

an outer tub that collects the overflow cleaning liquid from said cleaning bath; and a drain line that drains the overflow liquid from the outer tub to an exterior of the apparatus.

7. The apparatus for cleaning a polishing pad as claimed in claim 1, wherein the cleaning liquid includes deionized water.

8. The apparatus for cleaning a polishing pad as claimed in claim 1, wherein the inert gas includes a nitrogen gas.

9. An apparatus for cleaning a polishing pad conditioner comprising:

a cleaning bath that contains a cleaning liquid;

a gas injector that injects an inert gas into the cleaning liquid from a bottom of said cleaning bath, said gas injector including a plate having an interior space therein and formed with a plurality of pores in communication with the plate, a gas pipe, connected to a side of the plate, through which the inert gas is injected into the space, and a gas supplier that supplies the inert gas into the gas pipe; and a cleaning liquid supplier that supplies the cleaning liquid into said cleaning bath, wherein a center of an upper surface of the plate is convex and has a first thickness, and an edge portion of the plate has a second thickness, the first thickness being greater than the second thickness.

10. The apparatus for cleaning a polishing pad conditioner as claimed in claim 9, wherein the plate is made of an anti-corrosive material.

11. The apparatus for cleaning a polishing pad conditioner as claimed in claim 9, further comprising a drain that collects overflow cleaning liquid from said cleaning bath.

12. The apparatus for cleaning a polishing pad conditioner as claimed in claim 11, wherein said drain comprises:

an outer tub that collects the overflow cleaning liquid from said cleaning bath; and a drain line that drains the overflow liquid from the outer tub to an exterior of the apparatus.

13. The apparatus for cleaning a polishing pad as claimed in claim 9, wherein the cleaning liquid includes deionized water.

14. The apparatus for cleaning a polishing pad as claimed in claim 9, wherein the inert gas includes a nitrogen gas.

* * * * *